US007380355B2

(12) United States Patent
Donaldson

(10) Patent No.: US 7,380,355 B2
(45) Date of Patent: Jun. 3, 2008

(54) PORTABLE ICE RINK BUILDING AND RESURFACING DEVICE

(76) Inventor: Steven M. Donaldson, 20 Richland Dr., Richmond, Ontario (CA) K0A 2Z0

( * ) Notice: Subject to any disclaimer, the term of this patent is extended or adjusted under 35 U.S.C. 154(b) by 0 days.

(21) Appl. No.: 10/553,589

(22) PCT Filed: Apr. 16, 2004

(86) PCT No.: PCT/CA2004/000585

§ 371 (c)(1),
(2), (4) Date: Jun. 22, 2006

(87) PCT Pub. No.: WO2004/092485

PCT Pub. Date: Oct. 28, 2004

(65) Prior Publication Data

US 2006/0272181 A1 Dec. 7, 2006

(30) Foreign Application Priority Data

Apr. 17, 2003 (CA) ..... 2425722

(51) Int. Cl.
*E01H 5/10* (2006.01)

(52) U.S. Cl. ..... 37/219; 37/228

(58) Field of Classification Search ..... 37/219, 37/227, 228, 241; 299/24
See application file for complete search history.

(56) References Cited

U.S. PATENT DOCUMENTS 2,642,679 A 6/1953 Zamboni
2,763,939 A * 9/1956 Zamboni ..... 37/219
2,795,870 A 6/1957 Leduc
3,178,837 A 4/1965 Capalbo
3,277,885 A * 10/1966 Gontcharuk ..... 126/343.5 R
3,475,056 A * 10/1969 Jones ..... 299/24
3,484,961 A * 12/1969 Coslowsky ..... 37/227
3,622,205 A 11/1971 Zamboni
3,705,746 A 12/1972 McLeod
4,069,540 A 1/1978 Zamboni
4,084,763 A 4/1978 Zamboni
4,125,915 A 11/1978 Zamboni
4,356,584 A 11/1982 Zamboni
4,372,617 A 2/1983 Zamboni
4,705,320 A 11/1987 Zamboni
5,133,139 A 7/1992 Rzechula
5,771,698 A 6/1998 Abel
6,138,387 A 10/2000 Fox et al.

FOREIGN PATENT DOCUMENTS

CA 2178966 12/1997

OTHER PUBLICATIONS

Olympia Flood Cart, advertised by Resurfice Corp. (www.resurfice.com), 1 page, Feb. 17, 2003.

* cited by examiner

*Primary Examiner*—Gary S Hartmann
(74) *Attorney, Agent, or Firm*—Pearne & Gordon LLP

(57) ABSTRACT

A manually propelled ice rink building and resurfacing device. The device includes a chassis with removable wheels, a water tank mounted on the chassis, and a heating chamber within the water tank, the water tank receiving snow to be melted, the heating chamber in heat exchange relation to the water tank. Fluid dispensing means connected to the tank uniformly distributes, and evenly spreads a layer of water onto an ice rink surface. The device may be rolled on ice, dragged on snow, or stored in a vertical position.

13 Claims, 4 Drawing Sheets

PORTABLE ICE RINK BUILDING AND RESURFACING DEVICE

FIELD OF THE INVENTION

This invention relates to a portable ice rink surface building and resurfacing device. In particular, this invention relates to a device having a heating mechanism enabling the user to utilize snow as the source of water for distribution over the ice surface.

BACKGROUND OF THE INVENTION

This invention relates to a portable ice rink surface building and resurfacing device.

Due to the popularity of ice rinks based sport events such as competitive skating, hockey and curling, ice rink resurfacing equipment is well known in the art. The most popular ice rink resurfacing equipment is likely that sold under the trademark Zamboni, originally disclosed in U.S. Pat. No. 2,642,679, and later improved and refined and described for example by U.S. Pat. Nos. 3,622,205, 4,705,320, 4,372,617, 4,356,584, 4,125,915, 4,084,763, and 4,069,540, all issued to Zamboni. The self-propelled Zamboni ice rink resurfacing machines and other similar machines such as those sold under the Olympia trademark and other machines disclosed by U.S. Pat. Nos. 5,133,139 and 2,795,870, are based on the principle of shaving the surface of the ice, scraping the ice surface to remove ice shavings accumulated from skating and reapplying a smooth and thin layer of water which fills skate grooves and crevices and freezes to provide a smooth ice surface.

These large machines usually are the size of an automobile, as exemplified by the first model of the Zamboni, which was built on the chassis of a military surplus jeep. Due to their initial high capital cost and their inability to create de novo an ice rink, these large machines are suitable for large indoor ice rinks in commercial and non-commercial sports centers only. They are not designed for use in resurfacing remote rinks, outdoor skating ponds and backyard ice surfaces which are common in cold climates. To satisfy this market segment of ice rink resurfacing devices, several portable and non-self propelled resurfacing machines have been proposed to resurface smaller indoor rinks, outdoor skating ponds, neighborhood parks and remote ice rinks.

One class of such devices comprises hand-held manual ice resurfacers, as described in U.S. Pat. No. 5,771,698 and CA 2,178,966. Although both devices have different shapes, they both have a long handle for applying drag or push actions in order to resurface the ice rink. More importantly, both rely on an external water supply through a water hose to complete the resurfacing job. This limitation severely restricts the use of the devices to places near a water tap. Furthermore, in severely cold weather such as often happens in Canada and northern United States, the water hose can easily freeze. Draining and lugging water hoses is very cumbersome and the hoses must also be stored in a heated environment to prevent freezing.

Another class of devices tries to reduce this water supply dependency by incorporating a water tank on board. Two examples are illustrated in U.S. Pat. No. 6,138,387 and the Olympia Flood Cart advertised by Resurfice Corp. (www.resurfice.com). These designs, while alleviating the problems of external water dependency and water freezing at low temperature, do not solve the problems completely. That is, an external water source is still needed in proximity to the ice rink. Water can still freeze inside the water tank. The transporting of large quantities of water over a distance or over awkward terrain is a task particularly hard to do in hardy winter conditions. It is all the more frustrating if the water freezes at the destination before application. Moreover, the quality of an ice rink surface made using cold water is inferior compared to one made with warm water.

SUMMARY OF THE INVENTION

An object of the present invention is to provide an improved portable ice rink surface building and resurfacing device.

The present invention is directed to an ice rink surface building and resurfacing device having a chassis; a water tank mounted on the chassis, the water tank being adapted to receive snow, a heating mechanism mounted in heat exchange relation to the water tank to melt the snow; and a fluid disperser connected to the tank for distributing a layer of water onto an ice rink surface.

In accordance with one aspect of the invention, the chassis of the ice rink surface building and resurfacing device has a long flat-bottomed sled curved up at one end to form a toboggan shape. In accordance with a further aspect of the invention the heating mechanism uses combustible fuel material and includes a heat exchange chamber positioned within the water tank.

In accordance with preferred embodiment of the invention the water tank has a heat exchange mechanism parallel to, and near the chassis. The heating mechanism uses a burner using combustible fuel material and a series of horizontally oriented tubing in which the heated air circulates.

In accordance with a specific aspect of this invention, the device has two back wheels mounted on the chassis for moving the device and one smaller front wheel that is lowered when the device is not being transported along snow. Preferably the platform of the chassis is lower than the axis of the back wheels.

The foregoing objects and advantages of the present invention will become apparent to those skilled in the art to which this invention relates as this specification proceeds. The invention is herein described by reference to the accompanying illustrative embodiments forming a part hereof, which includes a description of the best mode known to the applicant and wherein like reference numbers refer to like parts throughout the several views, in which:

DETAILED DESCRIPTION

Figure 1:
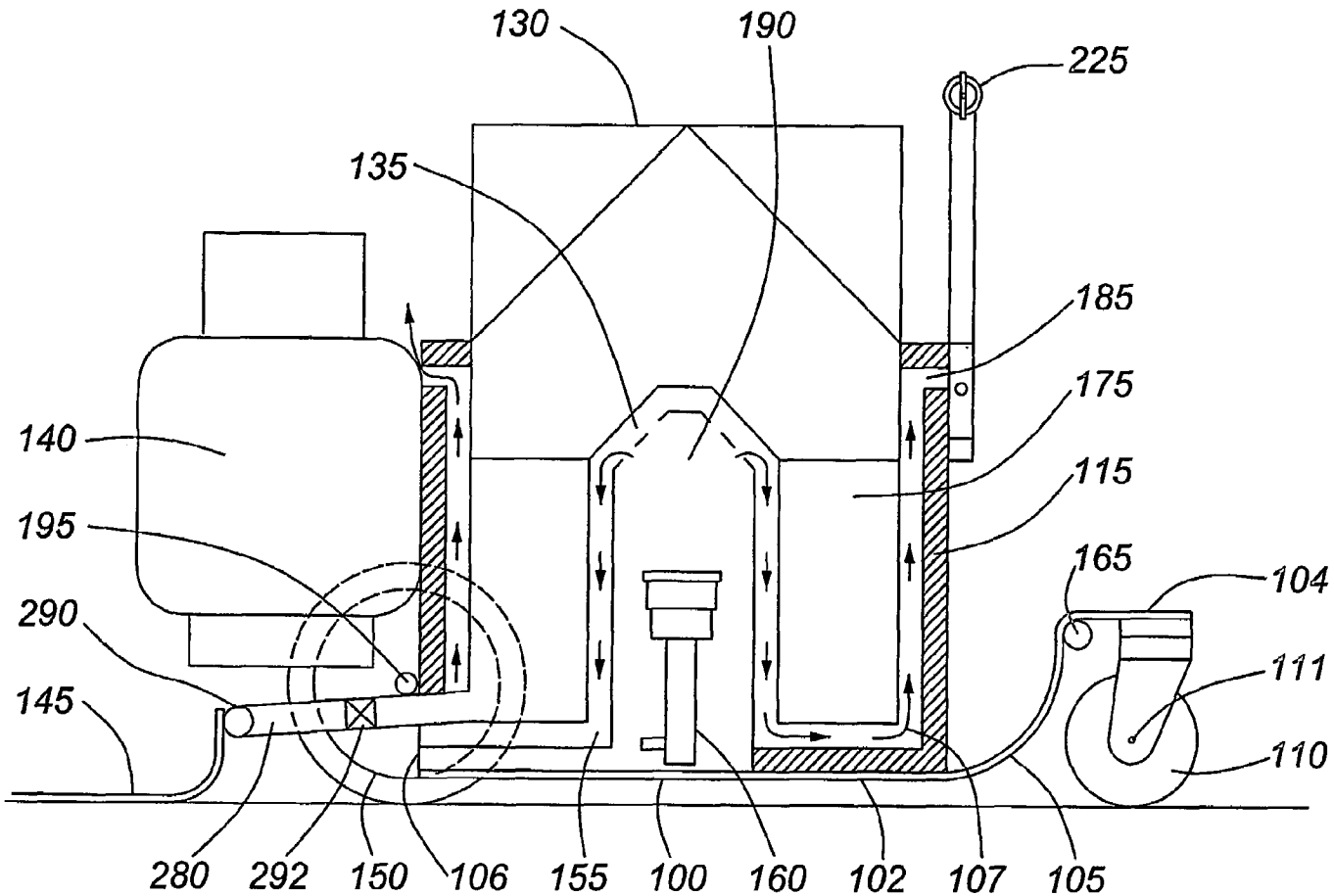
FIG. 1 is a longitudinal vertical cross-sectional view of a preferred embodiment of the ice rink resurfacing device according to the present invention.
Figure 2:
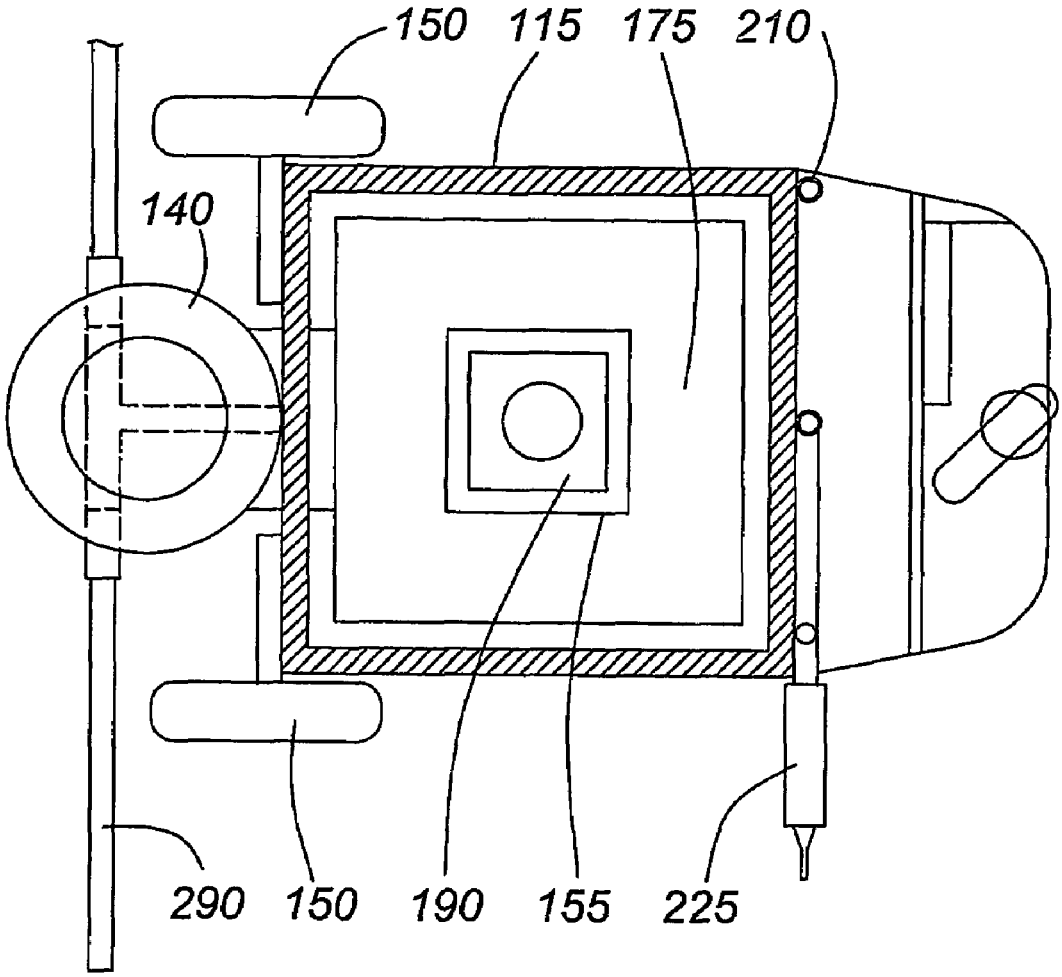
FIG. 2 is a cross-sectional view in top profile of the ice rink resurfacing device.

The embodiment of ice rink resurfacing device as shown in FIGS. 1 and 2 of the drawings comprises chassis (100) defined by a substantially flat rectangular plate (102) having an upturned curved flange (105) at the front of the device so that the chassis (100) as a whole has the shape of a toboggan. The flange (105) has an extended portion (104) at the front of the chassis. A swivel or castor wheel (110) is mounted to the extended chassis portion 104 at the front of the device. A rigid, square box-like cabinet (115) is mounted on the chassis (100).

Referring to FIGS. 1-2 a transverse axle (195) for rear support wheels (150) and a rearward fuel tank (140) are fixed to the rear face of cabinet (115). The rear wheels (150) are attached at the distal ends of the axle (195). The chassis plate (102) is mounted lower than the axle (195) for the rear wheels (150) and the axle (111) for the front castor wheel (110) such that the bottom of the chassis plate (102) preferably has a clearance of about 1½ inch above the ice surface. When in use, this design has the advantage of allowing the device to be rolled along on its wheels when on solid ice surface, and dragged as a toboggan when on snow beyond the ice surface thus facilitating transport both toward and away from an outdoor rink.

Three sockets (210) are welded to the upper extremities at the front of the cabinet in spaced apart relation to each other. An elongated horizontal F-shaped handle (225) is removably inserted into adjacent pair of the three sockets (210). This arrangement allows both left-handed and right-handed users to drag or push the device. Referring to FIG. 1 and FIG. 2 the F-shaped handle (225) is mounted in a position suitable for the benefit of the left-handed users.

Inside the cabinet (115) is a water tank (175) having a centrally located heating chamber (190) with a pyramid-formed top. A heat exchange mechanism defines a space (107) between water tank (175) and cabinet (115); space (155) between water tank (115) and heat chamber (190). Located inside the heating chamber (190) is a burner (160). The fresh air will enter an opening (106) at the bottom of the cabinet. Gases heated by the burner (160) in heating chamber (190) will rise to the top and exit through apertures (135) located at the top of the heating chamber. The heated gases travel first through the space (155) between the water tank and the heating chamber (190) and then through the space (107) between the water tank and the cabinet (115) thereby to transfer the heat to the fluid inside the water tank (175). The gases will exit at a opening (185). The transfer of the heat takes place inside and outside of the water tank providing high efficiency.

Inside the water tank (175) the snow is melted by the heat conducted through the wall of the water tank. The melted snow will reach the bottom of the water tank (175) by gravity. For easy reception of manually shoveled snow there is a hopper mounted on the top of the water tank. Between the hopper and the water tank (175) there is a filtering device for removing possible large solids from the snow (not shown).

The burner is connected to the fuel tank (140) through a tube (not shown) in connectional fashion. On top of the water tank (175) is a folding receptacle (130) for receiving the snow brought into the ice rink resurfacing device.

Referring now to FIG. 1 and FIG. 2 there is shown rearwardly extending pipe (280) connecting a water disperser (290) to the bottom of water tank (175). The water disperser (290) is in the form of a hollow telescopic structure which can be adjusted in length to provide the desired water application path width. The water disperser (290) has a plurality of small apertures arranged in a pattern on the bottom side. Connected to the full length of the water disperser is a flexible mat member (145) which contacts the ice surface as shown. The water dispersed by the water dispenser (290) is spread evenly over the existing rink surface by the mat member (145) to form a thin layer of ice. A control valve (292) in pipe (280) controls the flow of water from the tank (175) as required.

Figure 3:
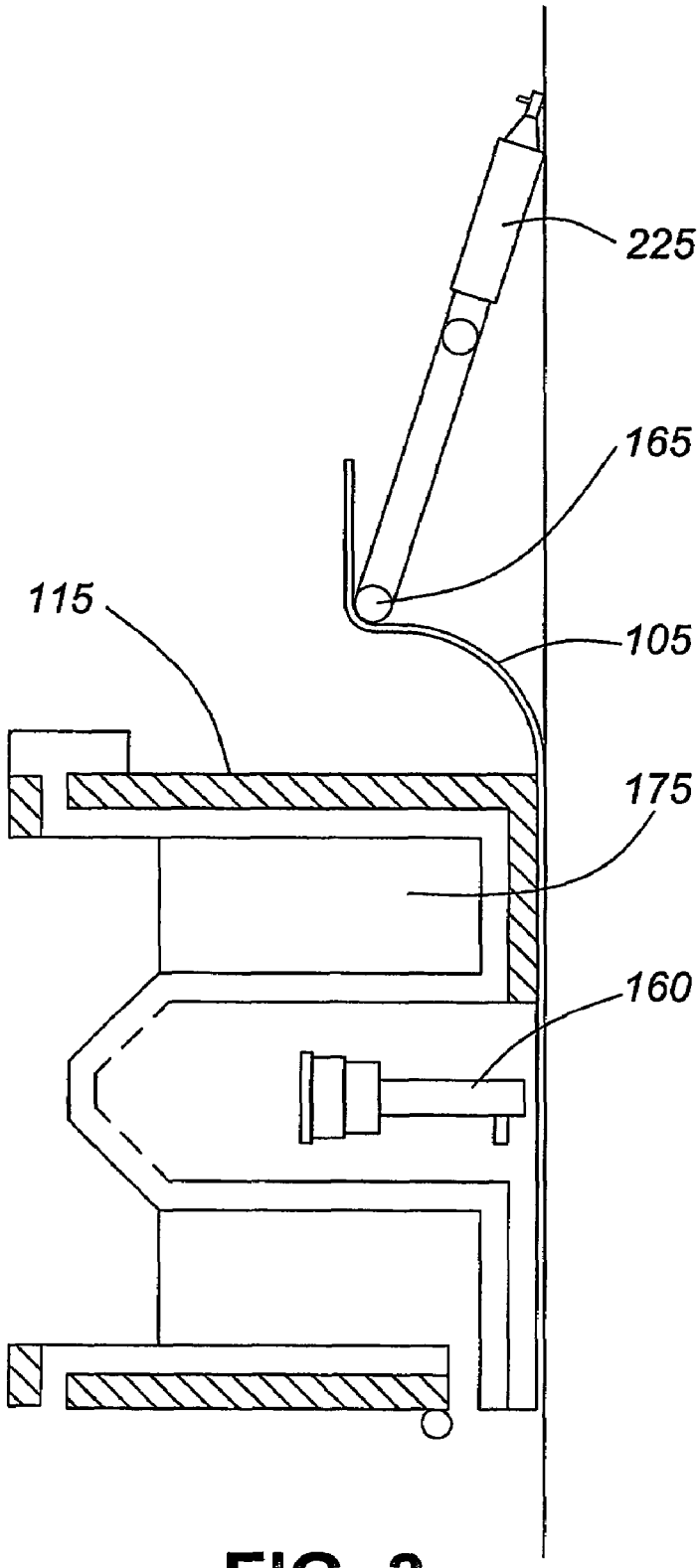
FIG. 3 is a longitudinal vertical cross-sectional view of the ice rink resurfacing device during the storage.

Referring now to FIG. 3 the ice rink surface building and resurfacing device is shown in storage. The rear wheels and the front castor are removed. The fuel tank (140) is stored separately. At the junction of upturned curved flange (105) and the extended chassis portion (104) there is a socket (165) which has the same diameter as the sockets (210) on the cabinet for hanging the device on a vertical surface. The elongated handle (225) is inserted into the socket (165).

A second preferred embodiment of an ice rink resurfacing device is similar to the first embodiment in many ways. In particular the device also includes a chassis defined by a substantially flat rectangular plate having an upturned curved flange at the front of the device so that the chassis as a whole has the shape of a toboggan. In this embodiment however, the flange has a handle at the front of the chassis. A swivel wheel is mounted to the handle at the front of the device. A rigid tank is mounted on the chassis.

As in the first embodiment, a transverse axle for rear support wheels and a rearward fuel tank are fixed to the rear face of the chassis. The rear wheels are attached at the distal ends of the axle. The chassis plate is mounted lower than the axle for the rear wheels and the axle such that the bottom of the chassis plate preferably has a clearance of about 1½ inch above the ice surface. When in use this design has the advantage of allowing the device to be rolled along on its wheels when on solid ice surface, and dragged as a toboggan when on snow beyond the ice surface thus facilitating transport both toward and away from an outdoor rink.

Inside the water tank it is preferred to have a gauge which displays the volume of water that is being generated. This allows the user to determine how much snow to shovel into the tank.

Figure 4A:
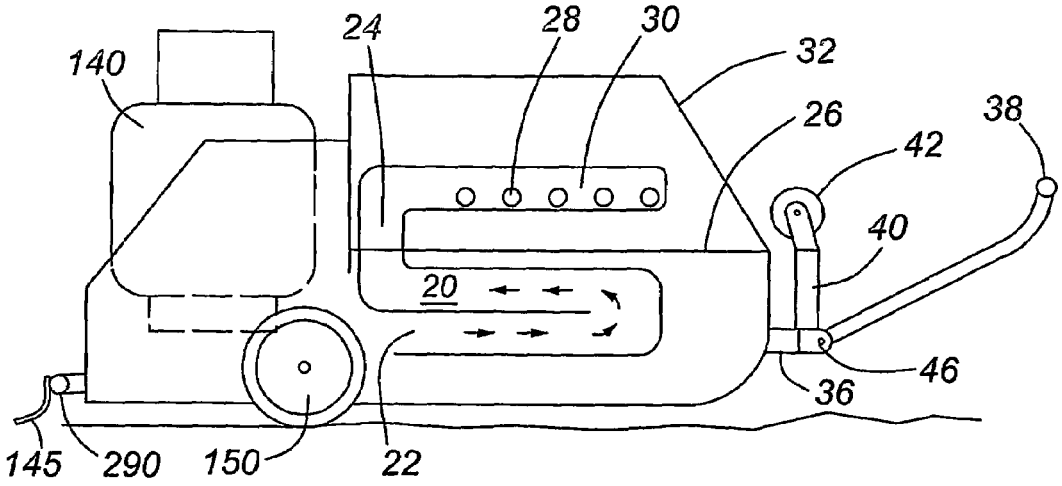
FIG. 4 is a side view (a) and a front view (b) of a second embodiment of a heating mechanism.
Figure 4B:
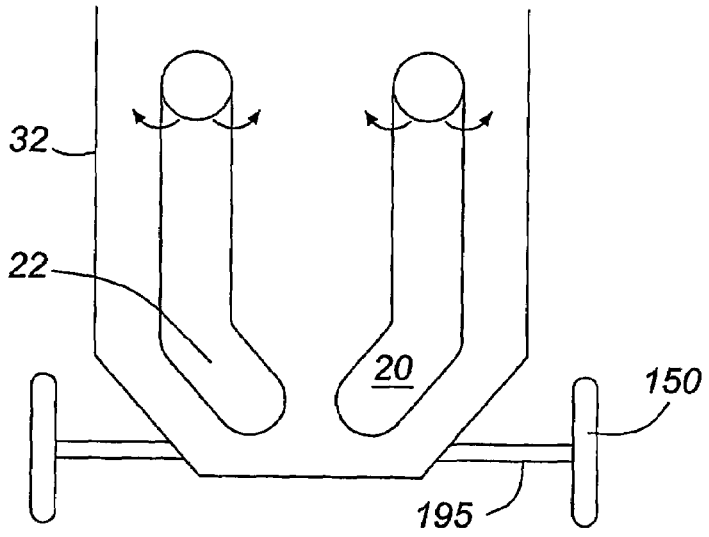

The substantive difference between the present embodiment and the first embodiment is the heating systems illustrated in FIGS. 4(*a*) and 4(*b*). Along the bottom of the water tank (32) is positioned a heating system (20) comprising of a propane burner (not shown) and a first elongated member (22) defining a heat path. The fresh air enters through openings on the bottom of the chassis. Gases heated by the burner travel first through the tubular heat path (22) circuiting along the bottom of the water tank (32). A vertical member, or a chimney (24) rises vertically above the high-water mark (26) and then extend horizontally to a second elongated member (30) to the back of the device for release of the gases into the open air. The horizontal section of the chimney has perforations (28) along the bottom to allow flue gases to contribute to the melting of the snow. The transfer of the heat takes place between the hot tubing members (22, 24) and the snow, and the water melted from the snow at the bottom of the tank (32), providing high efficiency.

Snow is melted by the heat conducted through the walls of the heat path (22) in the water tank (32). The flue gases exiting perforations (28) on the second elongated member (30) contributes to the melting process. The melted snow turns into water at the bottom of the water tank (32) combining the un-melted snow with the melted snow offers many advantages. Firstly, the water facilitates conductivity of heat into the snow. The water provides an efficient means for transferring the heat into the snow. Secondly, having the snow immersed in the water keeps the temperature of the water down. This prevents boiling and the loss of water due to evaporation and further bridging of the snow due to the affect of steam. Thirdly, it minimizes heat loss during all phases of the process. When there is less snow, the energy goes into raising the water temperature. If the snow is separate, when it reaches lower levels heat energy is lost into the outside air. Finally, combining the snow and water allows for accurate measures of volume towards the end of the melting cycle. The snow displaces the water in the tank equivalently to the volume it will generate once it is melted. The water gauge reflects this.

FIG. 4A illustrates a handle (38) which with a wheel (42). The wheel (42) is mounted an elongated member (40) which can be pivoted about the axis (36) between a first position for toboggan-like maneuvering of the device and a second position for cart-like maneuvering of the device. The relative position of the elongated member (40) and the handle (38) can also be adjusted.

For easy reception of manually shoveled snow the opening of the tank (32) is preferably low and broad. A broad opening facilitates user agitation of the snow should they wish to aid the melting process. The low profile creates a stable device for transportation while resurfacing because the weight of the water is not high. The low profile also allows the user to get a good view behind the device to see the area that is being resurfaced. There is a lid on the tank to keep heat inside and unwanted debris out.

As with respect to the embodiment illustrated in FIGS. 1 and 2, the burner is connected to the fuel tank (140) through a hose in connectional fashion. A rearward extending pipe connects a water disperser to the bottom of water tank (32). The water disperser is preferably in the form of a hollow removable structure to allow for storage inside and to use different dispersers for variable ice conditions. The water disperser has preferably a plurality of small apertures arranged on the top side of the water disperser to prevent blockage from debris. Trailing the full length of the water disperser is a removable flexible mat member which contacts the ice surface. The water dispersed by the water disperser is spread evenly over the existing rink surface by the mat member to form a thin layer of ice. A control valve in pipe controls the flow of water from the tank as required. A removable filter is optionally located in the water tank. It is preferably positioned before the pipe to screen debris from entering. It can be removable for cleaning.

The construction of the central located heating chamber in the first embodiment provides very efficient heat exchange, has heat exchange surfaces on both internal and external walls of the water tank minimizing the loss of heat, especially in colder climates. The efficient use of the warm water results in a better quality ice rink.

The construction of the horizontal heating member, oriented parallel, near the bottom of the water tank as described in the second embodiment also provides very efficient heat exchange, in contact only with the snow and water minimizing the loss of heat.

The efficient use of the warm water results in a better quality ice rink. In addition, because water is applied in thin layers, it will freeze faster, allowing skaters to use the rink soon after flooding.

One advantage of the present invention is that the portable ice rink surface building and resurfacing device is capable of using natural snow to build the ice rink, thereby eliminating the dependency on a separate water supply. Since no water supply is required, another advantage of the present invention is that the portable ice rink surface building and resurfacing device can readily create an ice rink at a remote place. Due to the simple construction of the device the present invention provides the economic advantages in use, in manufacture and in maintenance.

Another advantage of the present invention is that the portable ice rink surface building and resurfacing device has the chassis and the wheels constructed in an arrangement such that on a solid ice rink and other hard surfaces, the wheels will provide for ease of movement whereas on a snow covered surface the low clearance of the toboggan-shaped chassis will provide easy movement, enabling the device to be moved readily with relatively little effort in most cases as the back wheels will not penetrate far into the snow and impede movement. When transported along snow the user will pivot the front wheel upwards so that it does not impede movement.

The present invention has been described with regard to preferred embodiments. However, it will be obvious to persons skilled in the art that a number of variations and modifications can be made without departing from the scope of the invention as described herein. In the specification the word "comprising" is used as an open-ended term, substantially equivalent to the phrase "including but not limited to", and the word "comprises" has a corresponding meaning. Citation of references is not an admission that such references are prior art to the present invention.

What is claimed is:

1. A portable ice rink surface building and resurfacing device, comprising:

a chassis;

a water tank mounted on said chassis;

a heating mechanism mounted in heat exchange relation to the water tank;

the water tank being adapted to receive snow to be melted; and a fluid disperser connected to said tank for distributing a layer of water onto an ice rink surface, wherein the heating mechanism further comprises a first elongated member at the bottom of the water tank, said first elongated member being below a water line when in use; a vertical elongated member extending from said first elongated member; a second elongated member extending from said vertical elongated member, said second elongated member being parallel to the first elongated member and above the water line; said second elongated member having a plurality of perforation for releasing flue gas.

2. The device according to claim 1 wherein the fluid disperser further comprises a controller for regulating an amount of water being dispersed.

3. The device according to claim 1 wherein the chassis comprises a long flat-plate curved up at a forward end to provide a toboggan-like shape to enable skidding of the device over a snow covered surface.

4. The device according to claim 1, wherein heat of the flue gas contacts the snow received in the water tank and contributes to the melting of the snow.

5. The device according to claim 1 wherein a hopper is used to receive snow.

6. The device according to claim 5 wherein there is a filtering device between the hopper and the water tank for removing large solids.

7. The invention according to claim 1 wherein there is a filtering device between the water tank and the fluid disperser for removing solids.

8. The device according to claim 1 wherein the fluid disperser further comprises a fluid dispersing bar, said fluid dispersing bar having a plurality of holes for distributing a thin layer of water on horizontal surfaces.

9. The device according to claim 1 wherein the fluid disperser further comprises a fluid dispersing bar, said fluid dispersing bar having a telescopic structure.

10. The device according to claim 1 wherein the fluid disperser is a removable bar.

11. The device according to claim 1 further comprising supportive wheels and axles therefor, wherein the bottom of the chassis is located at a height lower than said axles.

12. A method of building an ice surface for a rink or resurfacing a rink comprising the steps of:

i) receiving snow in a portable rink building device; said device comprising:

a chassis;

a water tank mounted on said chassis;

a heating mechanism mounted in heat exchange relation to the water tank;

the water tank being adapted to receive snow to be melted;

and a fluid dispersing means connected to said tank for distributing a layer of water onto an ice rink surface, wherein the heating mechanism further comprises a first elongated member at the bottom of the water tank, said first elongated member being below a water line when in use; a vertical elongated member extending from said first elongated member; a second elongated member extending from said vertical elongated member, said second elongated member being parallel to the first elongated member and above the water line; said second elongated member having a plurality of perforation for releasing flue gas;

ii) melting the snow in said device; and iii) dispersing the water from melted snow onto the ice surface.

13. The method according to claim 12 wherein the rink is an outdoor rink.

* * * * *